US006817690B2

(12) United States Patent
Sato

(10) Patent No.: US 6,817,690 B2
(45) Date of Patent: Nov. 16, 2004

(54) PRINTING APPARATUS AND VOLTAGE CONTROL METHOD

(75) Inventor: Takashi Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/352,953

(22) Filed: Jan. 29, 2003

(65) Prior Publication Data

US 2003/0142156 A1 Jul. 31, 2003

(30) Foreign Application Priority Data

Jan. 31, 2002 (JP) ..... 2002-024105

(51) Int. Cl.[7] ..... B41J 29/38
(52) U.S. Cl. ..... 347/5; 347/19
(58) Field of Search ..... 347/5, 14, 19, 347/119

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,723,129 A 2/1988 Endo et al.
4,740,796 A 4/1988 Endo et al.
4,963,882 A * 10/1990 Hickman ..... 347/41
6,334,660 B1 * 1/2002 Holstun et al. ..... 347/19
2001/0022597 A1 * 9/2001 Yoshida ..... 347/14

FOREIGN PATENT DOCUMENTS

JP 59-123670 7/1984
JP 59-138461 8/1984

* cited by examiner

*Primary Examiner*—Thinh Nguyen
*Assistant Examiner*—Julian D. Huffman
(74) *Attorney, Agent, or Firm*—Fitzpatrick, Cella, Harper & Scinto

(57) ABSTRACT

The present invention provides a printing apparatus and voltage control method that can track instantaneous ON/OFF changes in the printing elements of the printhead and provide a steady voltage supply thereto, as well as restrain the voltage drop attendant upon such rapid load transitions. The present invention controls the drive voltage that drives the printhead including a plurality of printing elements mounted in a printing apparatus by inputting data transmitted from an external device, counting the number of printing elements to be driven, evaluating the extent of the load of the next single print cycle to be applied to the printhead, inputting an evaluation signal indicating the results of that evaluation to a voltage control unit that supplies a controlled voltage so as to drive the plurality of printing elements of the printhead, and adding a compensation voltage that compensates for the load-induced voltage drop that occurs when the printhead is driven.

10 Claims, 13 Drawing Sheets

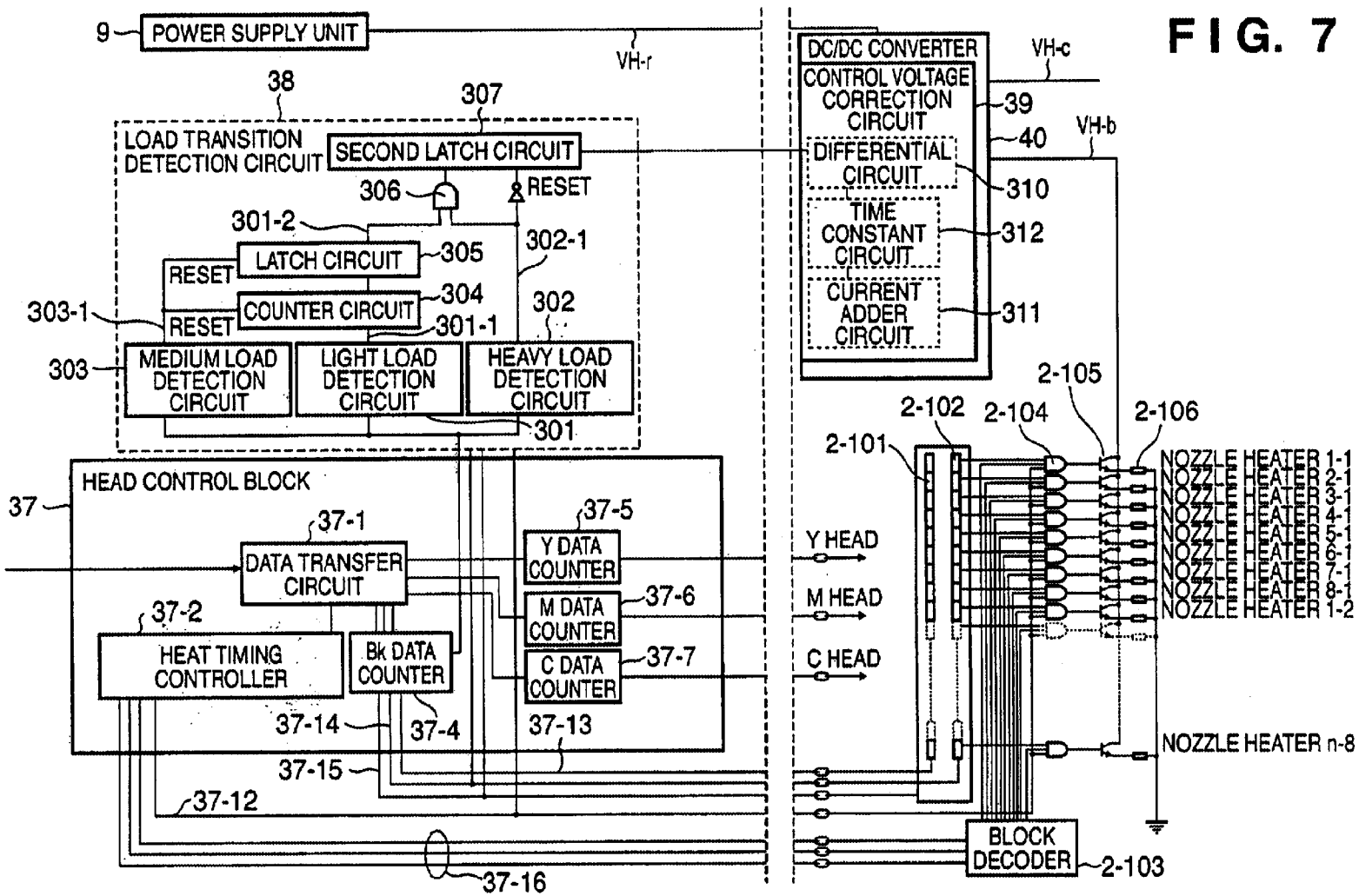
FIG. 7
DC/DC CONVERTER
CONTROL VOLTAGE CORRECTION CIRCUIT
DIFFERENTIAL CIRCUIT
TIME CONSTANT CIRCUIT
CURRENT ADDER CIRCUIT
VH-c
VH-b
VH-r
39
40
310
312
311
NOZZLE HEATER 1-1
NOZZLE HEATER 2-1
NOZZLE HEATER 3-1
NOZZLE HEATER 4-1
NOZZLE HEATER 5-1
NOZZLE HEATER 6-1
NOZZLE HEATER 7-1
NOZZLE HEATER 8-1
NOZZLE HEATER 1-2
NOZZLE HEATER n-8
2-106
2-105
2-104
2-102
2-101
2-103
BLOCK DECODER
Y HEAD
M HEAD
C HEAD
POWER SUPPLY UNIT
9
38
LOAD TRANSITION DETECTION CIRCUIT
SECOND LATCH CIRCUIT
307
306
RESET
302-1
302
305
304
301-1
301-2
LATCH CIRCUIT
COUNTER CIRCUIT
HEAVY LOAD DETECTION CIRCUIT
LIGHT LOAD DETECTION CIRCUIT
MEDIUM LOAD DETECTION CIRCUIT
301
303-1
303
HEAD CONTROL BLOCK
37
37-1
DATA TRANSFER CIRCUIT
37-2
HEAT TIMING CONTROLLER
37-4
Bk DATA COUNTER
37-5
Y DATA COUNTER
37-6
M DATA COUNTER
37-7
C DATA COUNTER
37-12
37-13
37-14
37-15
37-16

PRINTING APPARATUS AND VOLTAGE CONTROL METHOD

CLAIM OF PRIORITY

The present application claims priority from Japanese Patent Application No. 2002-024105, filed on Jan. 31, 2002, the entire contents of which are incorporated herein by reference.

FIELD OF THE INVENTION

The present invention relates to a printing apparatus and voltage control method, and more particularly, to a printing apparatus mounting a DC power source for driving an inkjet printhead on a head carriage substrate and a voltage control method.

BACKGROUND OF THE INVENTION

Conventionally, two types of printing apparatuses are known: A thermal transfer method type, and an inkjet method type, the latter involving the discharge of ink onto paper or some other printing medium so as to form text or images. Inkjet printing apparatuses, which are widely used as data output means such as printers, copiers, facsimile machines and the like, print by discharging ink while moving the relative positions of the printing medium and the inkjet printhead. As a result, controlling the relative speeds of the inkjet printhead and the printing medium, as well as controlling the timing of the ink discharge and stabilizing the supply of power to the printhead are crucial determinants of the quality of the final printed output.

Inkjet printing apparatuses are broadly divided into two types, depending on the shape of the inkjet printhead being used: the so-called serial type, and the full-line type. Of these, the serial type, which is the more widely used, prints by discharging ink while moving the inkjet printhead.

In addition, among printheads that discharge ink, there are those that use the action of a piezoelectric transducer to discharge the ink and those that use instantaneous film-boiling of the ink to discharge the ink. Those printheads that boil to discharge the ink send an electric current to a heater provided adjacent to an ink flow path at an ink discharge orifice and utilize the thermal energy generated by the current to boil the ink so as to provide the discharge energy.

In order to maintain the quality of the printed data, it is important to maintain a stable supply of energy with which to discharge the ink and further to ensure that the ink is discharged under uniform conditions so as to obtain ink droplets of uniform size and shape. However, in printing, the duty ratio changes depending on the print data, so the number of heaters activated simultaneously at any given time varies as well. As a result, the drive conditions fluctuate due to voltage fluctuations caused by differences in current output by the power source and drop voltage differences caused by resistance in the power supply sub-system.

Conventionally, such ink discharge control is executed in such a way as to satisfy stable discharge conditions by refining the accuracy of the power supply output voltage and by reducing the loss along the power supply sub-system.

In order to facilitate an understanding of the present invention, a description is first given of the DC/DC converter that supplies power to the printhead in an arrangement related to this invention.

FIG. 11 is a block diagram of a voltage control circuit that forms a part of a DC/DC converter carefully studied as an example when this invention was made. Note that this example is not well-known to an ordinarily skilled person in this art.

As shown in FIG. 11, an input voltage ($V_{in}$) to the DC/DC converter that is supplied from a power supply unit (not shown in the diagram) is input to a switching element 201. A DC output converted by the switching element 201 and a diode 209 is output via an inductor 202 and is supplied as output voltage (VH-b) to the printhead, which is the load. A first condenser 203 is coupled to the DC side of the switching element 201 and a second condenser 204 is coupled to the AC side of the switching element 201, with the inductor 202 and the second condenser 204 forming a smoothing circuit 205.

The output voltage signal (VH-b) detected at the output terminal of the smoothing circuit 205 is divided by a first resistance R1 and a second resistance R2 at a voltage control circuit 206 and input to the negative (–) terminal of a differential amplifier 207 that forms the voltage control circuit 206 and is used for feedback control. An output signal (V ref') from the differential amplifier 207 that inputs both the electric potential achieved by voltage-dividing the reference voltage (V ref) by a third resistance R3 and a fourth resistance R4 and the divided voltage of the above-described output voltage signal (VH-b) becomes the output signal of the voltage control circuit 206, and controls the switching element 201 through a PMW gate drive circuit 208 so as to execute constant voltage control.

It should be noted that a fifth resistance R5 and a condenser C1 connected between the inverted terminal and the output terminal of the differential amplifier 207 are one example of a phase compensation circuit.

As thus described, the output voltage signal (VH-b) is feedback controlled so as to provide stable output voltage in the face of the output current fluctuations caused by changes in the number of nozzles simultaneously driven on the printhead which is the load.

In order to cope with recent technological advances, by which faster computers have made it easier to achieve image output of color image processing as well as image output from high-resolution digital cameras, inkjet printing apparatuses used as output apparatuses have had to simultaneously provide improved picture quality as well as faster printing speeds. Faster printing speeds can be achieved by increasing the ink discharge frequency and increasing the number of nozzles discharged simultaneously, and both faster printing speed and improved picture quality are achieved by increasing the volume of ink discharged per unit of time in droplet increments.

However, an examination of increasing the number of nozzles that simultaneously or substantially simultaneously discharge as a way of increasing printing speed reveals that, of those nozzles readied for simultaneous discharge, the necessity of discharging ink changes according to the image to be printed at that time. Thus, for example, whereas printing an entire page black requires that all the nozzles that can discharge ink actually do so, images with a low duty rate such as tables and the like require ink discharge from only a portion of all available nozzles.

As described above, when serial printing types of inkjet printheads print, that is, discharge ink, such printing is carried out using heat generated by the flow of an electric current through a heater.

With such an ink discharge method, the current required also increases proportionally to the increase in the number of nozzles that discharge ink simultaneously. Yet the required current is not always constant and uniform but varies continuously depending on the data sent to the printhead in proportion to the number of nozzles discharging ink.

In other words, depending on the image data transmitted from an external device, at an inkjet printing apparatus that forms an image, pattern or pattern character on a printing medium, the volume of ink droplets discharged per unit of time is determined by the amount of image data transmitted from the external device, and similarly, the amount of electric power consumed by the printhead is determined by the amount of image data per unit of time.

That is, the greater the amount of image data per unit of time, the greater the number of nozzles put into a state in which they are capable of generating a simultaneous ink discharge and the greater the amount of power consumed by the printhead. Conversely, the smaller the amount of image data per unit of time, the smaller the number of nozzles that simultaneously discharge ink and the smaller the amount of power consumed by the printhead. Similarly, the electric current that the DC/DC converter should deliver to the printhead is determined in proportion to the number of nozzles that are to simultaneously discharge ink.

<Problems to be Solved in a Power Source>

Next, in order to further facilitate an understanding of the present invention, a description is given of the power source that supplies electrical power to the printhead.

From the power source side, in order to minimize fluctuation in the output voltage with respect to fluctuations in current attendant upon the number of heaters simultaneously driven of the printhead that is the load, the stationary gain (K) of the voltage feedback control circuit can be increased. However, increasing the stationary gain (K) not only destroys stability during no-load operation but can also give rise to non-linearity in the PWM control sub-system.

Accordingly, since the stationary gain (K) cannot be increased for the reasons described above, the conventional voltage control is incapable of adequately coping with instantaneous fluctuations in current caused by, for example, the rapid ON/OFF action of the load (that is, the heaters), thus causing the output voltage transient fluctuation characteristic to deteriorate. As a result, conventionally a capacitor component typified by an electrolytic condenser is inserted into the output terminal to convert instantaneous current into average current, thereby minimizing output voltage drops due to instantaneous fluctuations.

More specifically, the power source of an inkjet printing apparatus, in which the drive conditions of the printhead that discharges ink droplets according to image data transmitted from an external device, is designed to supply a stable output voltage in the face of instantaneous load transitions including all printhead drive conditions. A description of how this stable output voltage supply is accomplished follows.

First, with respect to the instantaneous current fluctuations, swinging rapidly through the specified rated maximum current amplitude of a printhead drive that moves from a no-load state in which there is no ink discharge at all to a state in which ink is discharged from all the nozzles, instantaneous current fluctuations are averaged out and output voltage fluctuations minimized by a capacitor component inserted into the output terminal of the voltage supply circuit. The capacitor component may be an aluminum electrolytic condenser. Where adequate gain (K) cannot be obtained and the constant voltage control circuit cannot track the instantaneous current fluctuations, releasing the electrical charge stored in the electrolytic condenser maintains the necessary supply voltage to the printhead.

The problem with the conventional art is that, during load transition periods, as the load current swings from a no-load state (in which ink is not discharged) to a maximum current peak value (at which there is ink discharge from all the nozzles), with the conventional constant voltage control circuit, which is based on error amplification using the electric potential difference between the reference voltage and the output voltage, the DC/DC converter constant voltage feedback amount (that is, the differential amplifier differential voltage) experiences a delay and begins to decouple from the control of the constant voltage control circuit of the DC/DC converter, and the output voltage declines below a predetermined set voltage. In addition, the conventional attempt to solve the foregoing problem by correcting for the drop in output voltage requires greatly increasing the capacity of the output condenser, which interferes with efforts to make the DC/DC converter smaller and thinner.

Moreover, high-speed, high-resolution inkjet printing apparatuses continue to undergo increases in the printing width of the printhead as well as increases in the number of nozzles in the printhead, resulting in a trend toward increasing the number of nozzles that discharge simultaneously. Since such developments tend to increase the output current peak amplitude during load transition periods, some means other than increasing the capacity of the condenser for correcting for the drop in output voltage during load transition periods is desired.

Considering the above-described problems inherent in the conventional examples, in which an increase in the number of nozzles leads, for example, to an increase in the amplitude of the instantaneous current fluctuations used to drive the printhead of the inkjet printing apparatus, it is desirable to continuously provide a stable voltage and to minimize drops in that voltage so as to suppress reductions in output voltage generated in the time interval during which the constant voltage control circuit cannot track instantaneous fluctuations caused by the rapid ON/OFF action of the printing elements of the printhead, without increasing the size of the electrolytic condenser capacity that acts to retain the voltage at the output terminal of the DC/DC converter.

SUMMARY OF THE INVENTION

Accordingly, it is an object of the present invention to provide a printing apparatus and voltage control method that tracks instantaneous current fluctuations due to rapid ON/OFF operation of the printing elements of the printhead and supplies a stable voltage to the printhead, and that also restrains a voltage drop.

According to one aspect of the present invention, the above-described object is attained by providing a printing apparatus for printing a printing medium by moving a printhead including a plurality of printing elements, comprising: input means for inputting print data transmitted from an external device; a carriage, in which the printhead is mounted and a voltage control unit that supplies a controlled voltage for driving the plurality of printing elements of the printhead, for moving the printhead; counting means for counting a number of printing elements of the printhead to be driven based on the print data input by the input means; evaluation means for evaluating an extent of a load of a succeeding print cycle to be applied to the printhead based on a count result by the counting means; and control means for inputting an evaluation signal indicating an evaluation result by the evaluation means to the voltage control unit, and controlling the voltage based on the evaluation signal.

Preferably, the above-described evaluation means evaluates the extent of the load in multiple stages and includes at least a light load detection circuit, a heavy load detection circuit and a medium load detection circuit.

In addition, preferably the voltage control unit is a DC/DC converter, with the DC/DC converter including a differential circuit that detects a signal change in the evaluation signal and an adder circuit that adds an output from the differential circuit to a reference voltage of the DC/DC converter. Moreover, preferably the DC/DC converter further comprises a time constant circuit for dampening detection of a signal change by the differential circuit.

Preferably, the above-described printhead is an inkjet printhead that prints by discharging ink, comprising (1) a first inkjet printhead that discharges black ink, (2) a second inkjet printhead that discharges cyan ink, (3) a third inkjet printhead that discharges magenta ink and (4) a fourth inkjet printhead that discharges yellow ink. Preferably, the inkjet printhead comprises an electrothermal transducer that generates thermal energy to be added to the ink in order to discharge ink.

Moreover, preferably the counting means counts each black data, cyan data, magenta data and yellow data color component. In such a case, preferably the evaluation means outputs a black-and-white evaluation signal based on the black data and a color evaluation signal based on the cyan data, the magenta data and the yellow data, and the voltage control unit supplies both a drive voltage for black-and-white printing and a drive voltage for color printing.

According to another aspect of the present invention, the foregoing object is achieved by providing a voltage control method for controlling a drive voltage for driving a printhead having a plurality of printing elements mounted on a printing apparatus for printing on a printing medium, comprising the steps of: inputting print data transmitted from an external device; counting a number of printing elements of the printhead to be driven based on the input print data; evaluating an extent of a load of a succeeding print cycle to be applied to the printhead based on the count result; and inputting an evaluation signal indicating the evaluation result to a voltage control unit for supplying a controlled voltage so as to drive the plurality of printing elements, and controlling the voltage based on the evaluation signal.

In accordance with the present invention as described above, in order to control a drive voltage for driving a printhead having a plurality of printing elements mounted on a printing apparatus for printing onto a printing medium, print data transmitted from an external device is input and, based on that input print data, the number of printing elements of the printhead to be driven simultaneously is counted and, based on the results of that count, the extent of the load of the next single print cycle to be applied to the printhead is evaluated, an evaluation signal indicating the evaluation results is input to a voltage control unit that supplies a controlled voltage for driving the plurality of printing elements of the printhead, and a compensation voltage to compensate for a voltage drop caused by the load when driving the printhead is applied based on that evaluation signal.

The invention is particularly advantageous insofar as it can track instantaneous current fluctuations due to rapid ON/OFF operation of the printing elements of the printhead and supply a stable voltage to the printhead, as well as restrain a voltage drop.

Other objects, features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention, in which:

FIG. 7 is a block diagram of the internal construction of the head control block 37, the load transition detection circuit 38, the control voltage correction circuit 39 and the printhead of an inkjet printing apparatus according to a second embodiment of the present invention;

DETAILED DESCRIPTION OF THE PREFERRED EMBODIMENTS

Preferred embodiments of the present invention will be described in detail, in accordance with the accompanying drawings.

The following embodiment exemplifies a printing apparatus which employs an inkjet printhead.

In this specification, "print" not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, a "printing medium" not only includes a paper sheet used in common printing apparatuses, but also broadly includes materials, such as cloth, a plastic film, a metal plate, glass, ceramics, wood, and leather, capable of accepting ink.

Furthermore, "ink" (to be also referred to as a "liquid" hereinafter) should be extensively interpreted similar to the definition of "print" described above. That is, "ink" includes a liquid which, when applied onto a printing medium, can form images, figures, patterns, and the like, can process the printing medium, and can process ink (e.g., can solidify or insolubilize a coloring agent contained in ink applied to the printing medium).

Figure 1:
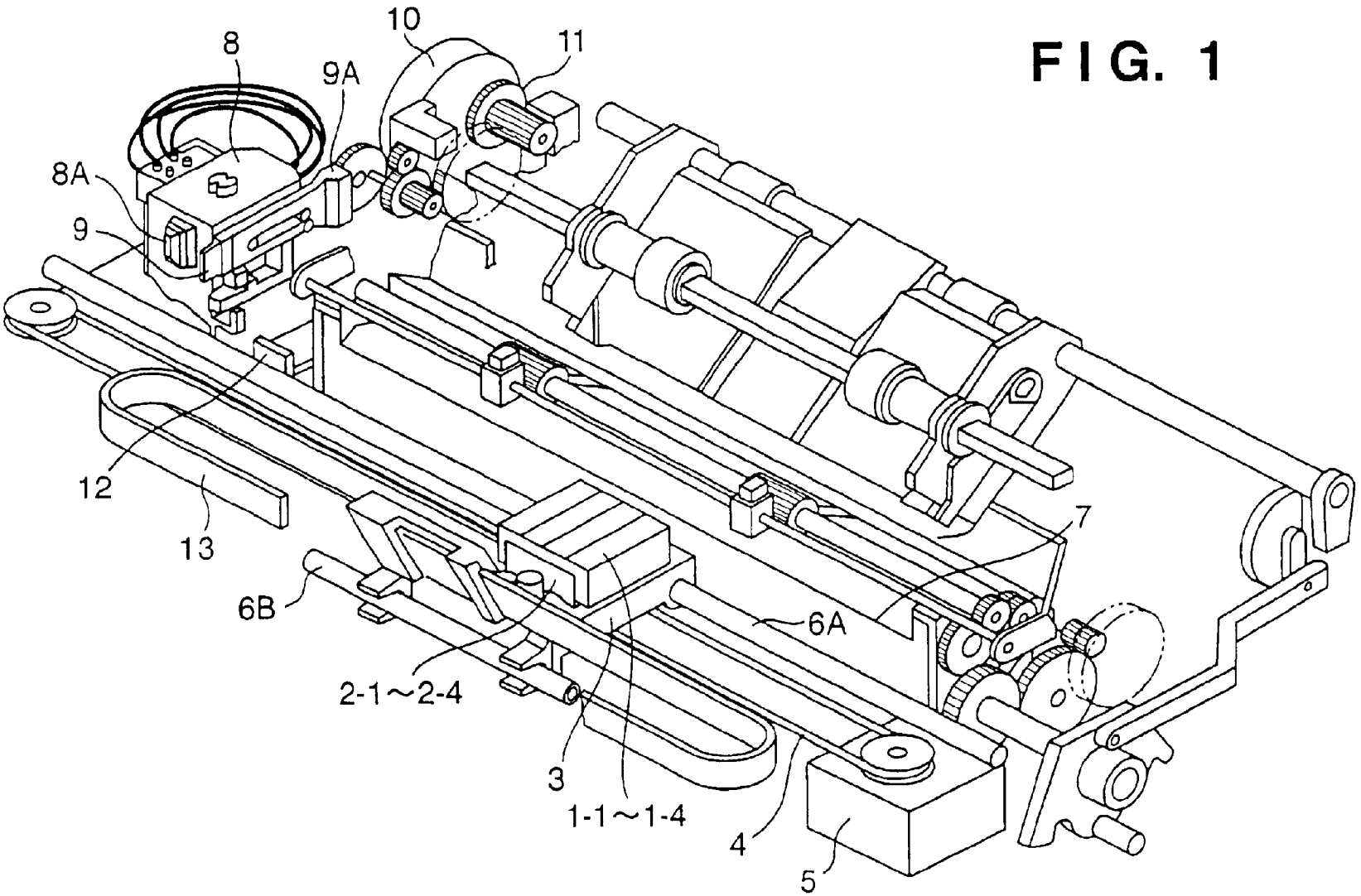
FIG. 1 is a perspective view of the overall construction of an inkjet printing apparatus according to a typical embodiment of the present invention.

FIG. 1 is a perspective view of the overall construction of an inkjet printing apparatus according to a first embodiment of the present invention.

As shown in FIG. 1, the inkjet printing apparatus mounts four detachable inkjet printheads (hereinafter printheads) for color printing, denoted by reference numerals 2-1, 2-2, 2-3 and 2-4 (collectively, 2-1 through 2-4). Printhead 2-1 discharges black (Bk) ink, printhead 2-2 discharges yellow (Y) ink, printhead 2-3 discharges magenta (M) ink and printhead 2-4 discharges cyan (C) ink. Accordingly, ink tanks 1-1, 1-2, 1-3 and 1-4 corresponding to the four printheads 2-1 through 2-4 are provided, in order to supply the printheads 2-1 through 2-4 with ink of the respective colors. The ink tanks 1-1 through 1-4 and printheads 2-1 through 2-4 are integrally mounted on the carriage 3. An optical home position sensor 8 (hereinafter HP sensor 8) is also mounted on the carriage 3.

A carriage 3 mounting these ink tanks and printheads is linked to a portion of a drive belt 4 that transmits a drive force of a carriage drive motor 5 and is mounted so as to be movable with respect to guide shafts 6A, 6B mounted parallel to a carriage scanning direction. The drive force generated by the carriage drive motor 5 drives the carriage 3 back and forth across the width of a sheet of paper fed from an APF (Automatic Paper Feeding mechanism) (not shown in the diagram) to a platen 7 disposed opposite a discharge surface of the printheads 2-1 through 2-4 so as to print.

The printheads 2-1 through 2-4 are configured so as to align the plurality of nozzles shaped like thin narrow pipes for discharging ink along the discharge surface disposed opposite the printing surface of the paper, with heaters, provided in the vicinity of the nozzles, that generate thermal energy in order to impart discharge energy to the ink supplied from the integrated ink tanks 1-1 through 1-4. The nozzles of printheads 2-1 through 2-4 are arranged so as to be aligned in a direction perpendicular to the direction of scanning by the carriage, with the four printheads aligned in the scanning direction of the carriage 3.

In addition, when the carriage 3 moves along the guide shafts 6A, 6B during initialization, the HP sensor 8 uses a reference position detection tab 12 to determine the reference position (that is, the carriage home position) in the scanning direction of printing.

The inkjet printing apparatus receives image data, control commands and the like input from an external host device at a print control circuit to be described later. The print control circuit then develops color image data according to the data so received, which the print control circuit then forwards to the printhead and also causes the carriage 3 to scan while controlling the print sequence so as to discharge ink as required, that is, at the required timing. The print control circuit and the carriage 3 are connected by a flexible cable 13, which supplies signals, and the electric power necessary to discharge the ink, to the printheads.

It should be noted that, in FIG. 1, reference numeral 8 denotes a suction pump for carrying out suction recovery of the printhead, reference numeral 8A denotes a suction cap for capping the nozzles of the printhead, reference numeral 9 denotes a cleaning blade for wiping clean the nozzle surface of the printhead, reference numeral 9A denotes a blade gear, reference numeral 10 denotes a conveyance motor that generates a drive force to convey paper and reference numeral 11 denotes a conveyance gear.

Figure 2:
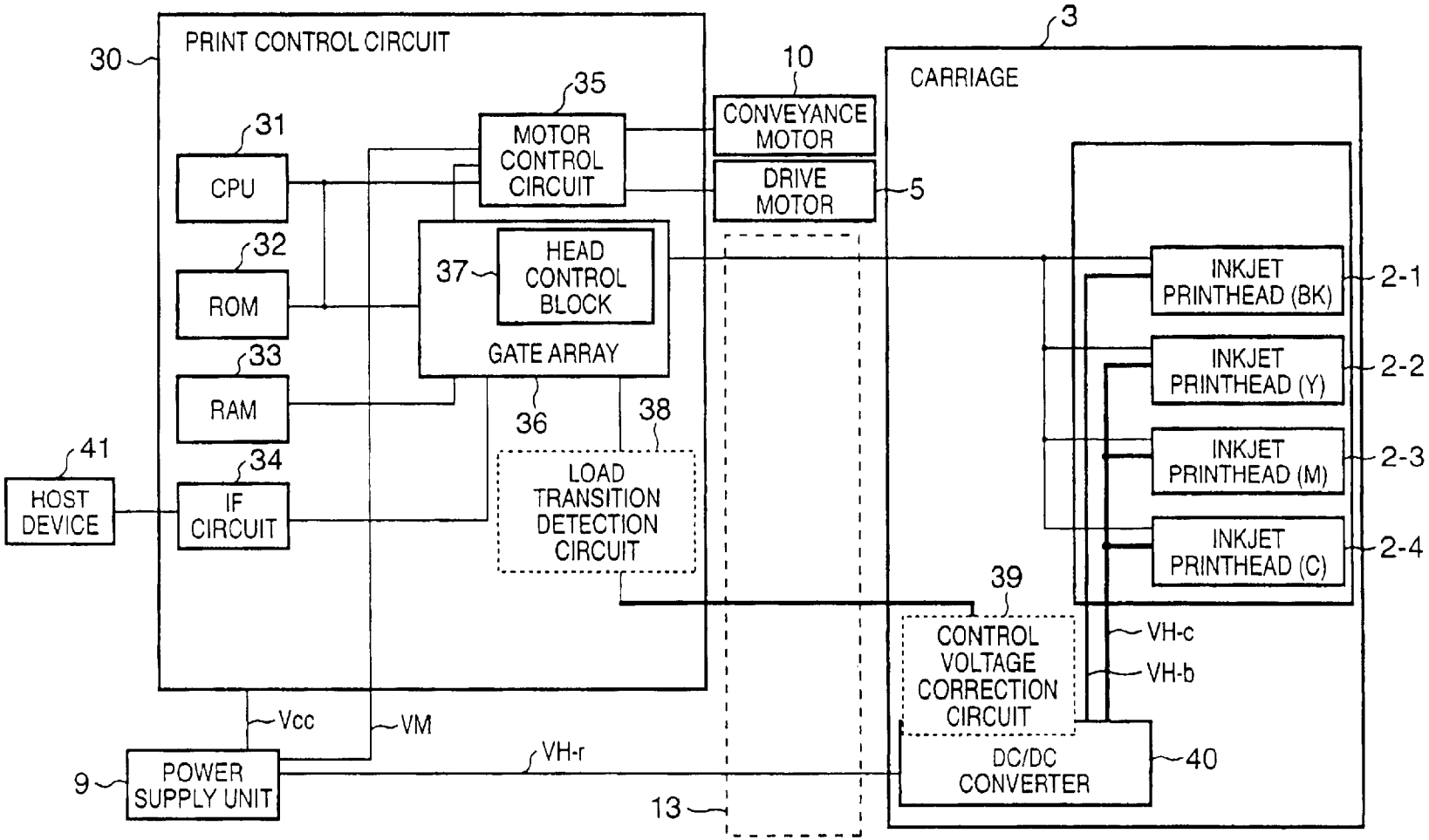
FIG. 2 is a block diagram of a print control circuit and a carriage construction of the inkjet printing apparatus.

FIG. 2 is a block diagram of a print control circuit and a carriage construction of the inkjet printing apparatus.

A print control circuit 30 comprises a CPU 31, a ROM 32, a RAM 33, an interface (IF) circuit 34 that is the interface with the external apparatus host device 41, a motor control circuit 35 that drives the carriage drive motor 5 and the conveyance motor 10, a gate array 36 that complements the operation of the CPU 31 and is composed of logic circuits that perform various controls and a load transition detection circuit 38.

In addition, a head control block 37 that drives the printheads 2-1 through 2-4 and controls timing of the ink discharge is configured inside the gate array 36.

A stepping motor is used for the carriage drive motor 5. In order to move the carriage 3, the CPU 31 transmits carriage motor drive signals to the motor control circuit 35 while at the same time tracking a current position of the carriage by monitoring the number of operating signals from a scanning direction reference position.

When the carriage 3 moves to a location at which the mounted printheads 2-1 through 2-4 are to discharge ink, the head control block 37 operates to cause the printheads to discharge ink.

It should be noted that, in the present embodiment, the print position of the carriage 3 in the scanning direction is detected by monitoring the motor drive pulses. However, a dedicated encoder may be used instead to detect the position of the carriage.

The CPU 31 controls the overall operation of the inkjet printing apparatus according to programs pre-stored in the ROM 32 or control commands input from a host device 41 via the interface circuit 34. The ROM 32 contains programs for running the CPU 31 as well as a variety of table data needed for head control and character data for creating text data.

The interface circuit 34 is the interface for control commands and control data input and output between the host device 41 and inkjet printing apparatus. The RAM 31 contains work areas for when the CPU 31 executes calculations as well as temporary storage areas for print data and control commands input from the host device 41 via the interface circuit 34. The RAM 33 is provided with a print buffer for storing bit map data after the print data has been developed into bit data corresponding to the nozzles of the printheads 2-1 through 2-4.

A power supply unit 9 supplies a $V_{cc}$ voltage to the print control circuit 30, a VM voltage to the motor control circuit 35, the conveyance motor 10 and the drive motor 5, and a VH-r voltage to the DC/DC converter 40 via the flexible cable 13.

The load transition detection circuit 38 described above detects the number of pixels corresponding to the number of nozzles of the printhead to be driven by a serial data signal that is part of the control signal sent to the carriage 3 from the gate array 36 including the head control block 37, detects a transient state of a predetermined number of pixels, and variably controls the head drive voltages VH-b and VH-c that are the output voltages of the DC/DC converter 40 by transmitting a control signal to a control voltage correction circuit 39 provided on the carriage 3 via the flexible cable 13.

A description is now given of two embodiments of the present invention in order to illustrate control of the head drive voltage of an inkjet printing apparatus having the structure described above.

<First Embodiment>

A description is now given of a inkjet printing apparatus according to a first embodiment of the present invention, with reference to FIGS. 3, 4, 5A, 5B and 6.

In order to facilitate an understanding of the present embodiment, a description is first given of the inkjet printhead discharge circuit and discharge control.

Figure 3:
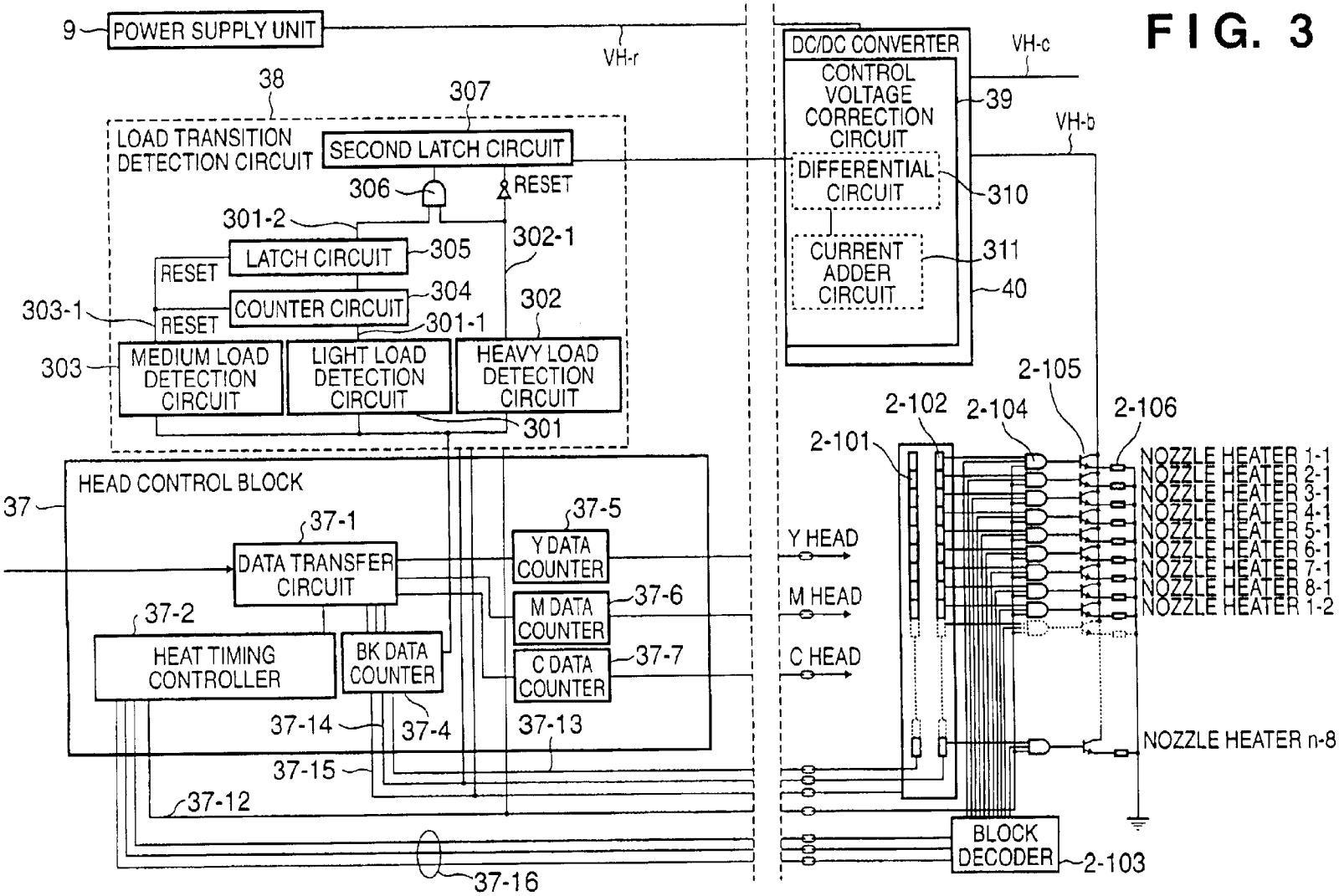
FIG. 3 is a block diagram of the internal construction of a head control block 37, a load transition detection circuit 38, a control voltage correction circuit 39 and the printhead of an inkjet printing apparatus according to a first embodiment of the present invention.

FIG. 3 is a block diagram of the internal construction of a head control block 37, a load transition detection circuit 38, a control voltage correction circuit 39 and the printhead of an inkjet printing apparatus according to a first embodiment of the present invention.

As indicated in FIG. 3, the head control block 37 and the load transition detection circuit 38 are provided within a main body of the printing apparatus, while the control voltage correction circuit 39 is provided in the carriage 3 to which the printhead is mounted.

It should be noted that, although four printheads 2-1 through 2-4 are shown in FIG. 1, in reality all operate according to the same principle, so for the sake of simplicity a description of only one such printhead 2-1 shown in FIG. 3 is given, on the understanding that the description given of printhead 2-1 applies also to the other printheads 2-2, 2-3 and 2-4 not specifically described herein.

First, a description is given of a driving sequence in a single print cycle of a printhead.

As shown in FIG. 3, a data transferring circuit 37-1 of the head control block 37 outputs a serial data signal 37-13, a clock signal 37-15 and a latch signal 37-14 in order to output discharge data to the printhead. Signal lines for transferring these signals are connected to the printhead 2-1.

The serial data signal 37-13 is synchronized with the clock signal 37-15 and sequentially stored in a shift register 2-101 included in the printhead 2-1. When transmission of data of a number of nozzles is completed, a latch signal 37-14 is transmitted and the data stored in the shift register 2-101 is moved to the shift register 2-102, completing setting of the data.

When the data set is completed, a block selection signal 37-16 sent from a heat timing controller 37-2 over three signal wires is used for the purpose of selecting which of the nozzles provided on the printhead 2-1 is to discharge ink in accordance with the position of the carriage 3. A heat signal 37-12 is transmitted over a single signal line. In the present embodiment, printing elements (nozzles) of the same block that are to be driven at the same time (that is, have the same drive timing) are disposed at every eighth nozzle of the nozzle rows of the printhead. For the blocks selected by the three block selection signals 37-16, a decoder 2-103 provided on the printhead 2-1 activates decoder input of an AND circuit 2-104 that corresponds to the block.

When a heat signal 37-12 is input for printing elements (nozzles) that have been data set and block selected according to the sequence described above, and the output conditions of the AND circuit 2-104 have been satisfied, drive transistors 2-105 connected to heat resistances (nozzle heaters) 2-106 for each of the nozzles is activated and a heat current is sent to the nozzle heater. The heat signal 37-12 is used for temperature control, that is, for controlling the actual heating time.

Ink droplets are discharged and a printing sequence is achieved by a continuation of the operations of a single cycle as described above.

Next, a description is given of the operation of the load transition detection circuit 38.

A black (BK) data counter that 37-4 counts the number of data (the number of printed bits or the number of ON bits) for causing discharge of black (Bk) ink of the print data is connected to a light load detection circuit 301, a heavy load detection circuit 302 and a medium load detection circuit 303. The BK data counter 37-4 then counts the number of nozzles (the number of nozzles to be driven based on the ON bit data) from which ink is actually to be discharged based on the serial data signal 37-13 described above. The light load detection circuit 301, heavy load detection circuit 302 and medium load detection circuit 303 then each detect whether the load is light, medium or heavy depending on a numerical range of nozzles for discharge that is predefined, from the count data.

The detection performed by the light load detection circuit 301, heavy load detection circuit 302 and medium load detection circuit 303 is determined in advance by the number of nozzles of the printhead, the number of nozzles to discharge simultaneously or substantially simultaneously and the DC/DC converter feedback control circuit step response performance. The amount of the current supplied from the DC/DC converter, which changes according to the number of nozzles to be discharged as compared to the total number of nozzles provided on the printhead, is then detected in three stages by the light load detection circuit 301, heavy load detection circuit 302 and medium load detection circuit 303.

As can be appreciated by those of ordinary skill in the art, the detection circuits described above may not only detect the amount of the current in just three stages as in the present embodiment but may also be set to n stages whose value is obtained from dividing the total number of nozzles of the printhead mounted on the carriage 3 by any positive integer.

As described above, the light load detection circuit 301, heavy load detection circuit 302 and medium load detection circuit 303 generate detection signals corresponding to the number of nozzles to discharge simultaneously from the signals counted by the BK data counter 37-4 from the serial data signals 37-13. One or the other of the light load detection circuit 301, heavy load detection circuit 302 or medium load detection circuit 303 reacts to all serial print signals 37-13 for one cycle print operation, detecting whether the load is heavy, medium or light, as the case may be. In addition, when considered instant by instant, for any given serial data signal 37-13, only one of the light load detection circuit 301, heavy load detection circuit 302 and medium load detection circuit 303 reacts.

If signals from the BK data counter 37-4 indicates that there is no print data causing to discharge ink in the serial data signal 37-13, or if only an extremely small amount of such data is detected, the light load detection circuit 301 transmits a detection signal 301-1 to the counter circuit 304. The transmitted detection signal is counted by the counter circuit 304 and a HIGH signal continues to be output to the AND circuit 306 by a latch circuit 305 if the light load continues for more than a certain length of time. However, so long as there is print data set in the serial data signal 37-13 to cause the simultaneous discharge of ink from a predetermined number or more of nozzles, the light load detection circuit 301 does not transmit the detection signal 301-1 (or continues to output a LOW signal).

The medium load detection circuit 303 detects the number of nozzles to discharge simultaneously of a range that is detected by neither the light load detection circuit 301 nor the heavy load detection circuit 302, with respect to the print data for generating ink discharge that is transmitted by the serial data signal 37-13 from the BK data counter 37-4. When the medium load detection circuit 303 does detect a number of nozzles to be discharged simultaneously that is within a range that is detected by neither the light load detection circuit 301 nor heavy load detection circuit 302, the medium load detection circuit 303 transmits a detection signal 303-1. When the medium load detection circuit 303 detects a medium load based on the print data from the serial data signal 37-13, the medium load detection circuit 303 transmits a reset signal to the counter circuit 304 connected to the light load detection circuit 301 and to the reset terminal of the latch circuit 305, which is also connected to the light load detection circuit 301, thereby resetting the count at the counter circuit 304 and the latched data at the latch circuit 305.

The heavy load detection circuit 302 detects when the print data that generates an ink discharge from the signals from the BK data counter 37-4 indicates that all or most (e.g., more than 80% of all nozzles) of the nozzles are set to discharge ink simultaneously. The instant that detection is made, that is, just before the serial print signal 37-13 is stored in the register 2-102, the heavy load detection circuit 302 outputs a HIGH signal to the AND circuit 306 as a detection signal 302-1. By contrast, if the print data indicates that the number of nozzles to discharge ink simultaneously is at or below a set value, the heavy load detection circuit 302 does not output the detection signal 302-1 (or the signal to the AND circuit 306 remains LOW).

The AND circuit 306, (i) when a detection signal 301-1 that the light load detection circuit 301 outputs to one of the input terminals of the AND circuit 306 is detected for more than a certain length of time arbitrarily set by the counter circuit 304 and a HIGH signal 301-2 output from the latch circuit 305 is input, and (ii) when a HIGH signal is input to the other of the input terminals of the AND circuit 306 just before the serial data signal 37-13 detected by the heavy load detection circuit 302 is set in the shift register 2-101 by the heavy load detection circuit 302, conditions for a HIGH signal to be output from the AND circuit 306 are in place and the output terminal of the AND circuit 306 outputs a HIGH signal, which is synchronized with the heat signal 37-12 and transmitted to the control voltage correction circuit 39 of the DC/DC converter 40 via a second latch circuit 307.

That is, a control signal is synchronized with the nozzle heater drive and transmitted to the control voltage correction circuit 39 of the DC/DC converter 40.

Thus, the number of nozzles scheduled to discharge ink simultaneously in the next print cycle can be determined from the serial data signal 37-13 in three distinct stages using the light load detection circuit 301, heavy load detection circuit 302 and medium load detection circuit 303 as described above while the serial signals 37-13 are being stored in the register 2-101 by the BK data counter 37-4 successively counting the serial data signals 37-13. Then, a control signal is synchronized with the nozzle heater drive and transmitted to the control voltage correction circuit 39 of the DC/DC converter 40.

The output of the latch circuit 307 of the load transition detection circuit 38 is connected to the differential circuit 310 of the control voltage correction circuit 39, a logic signal indicating the output is differentiated by the differential circuit 310, and an edge portion of the logic signal is extracted.

Figure 4:
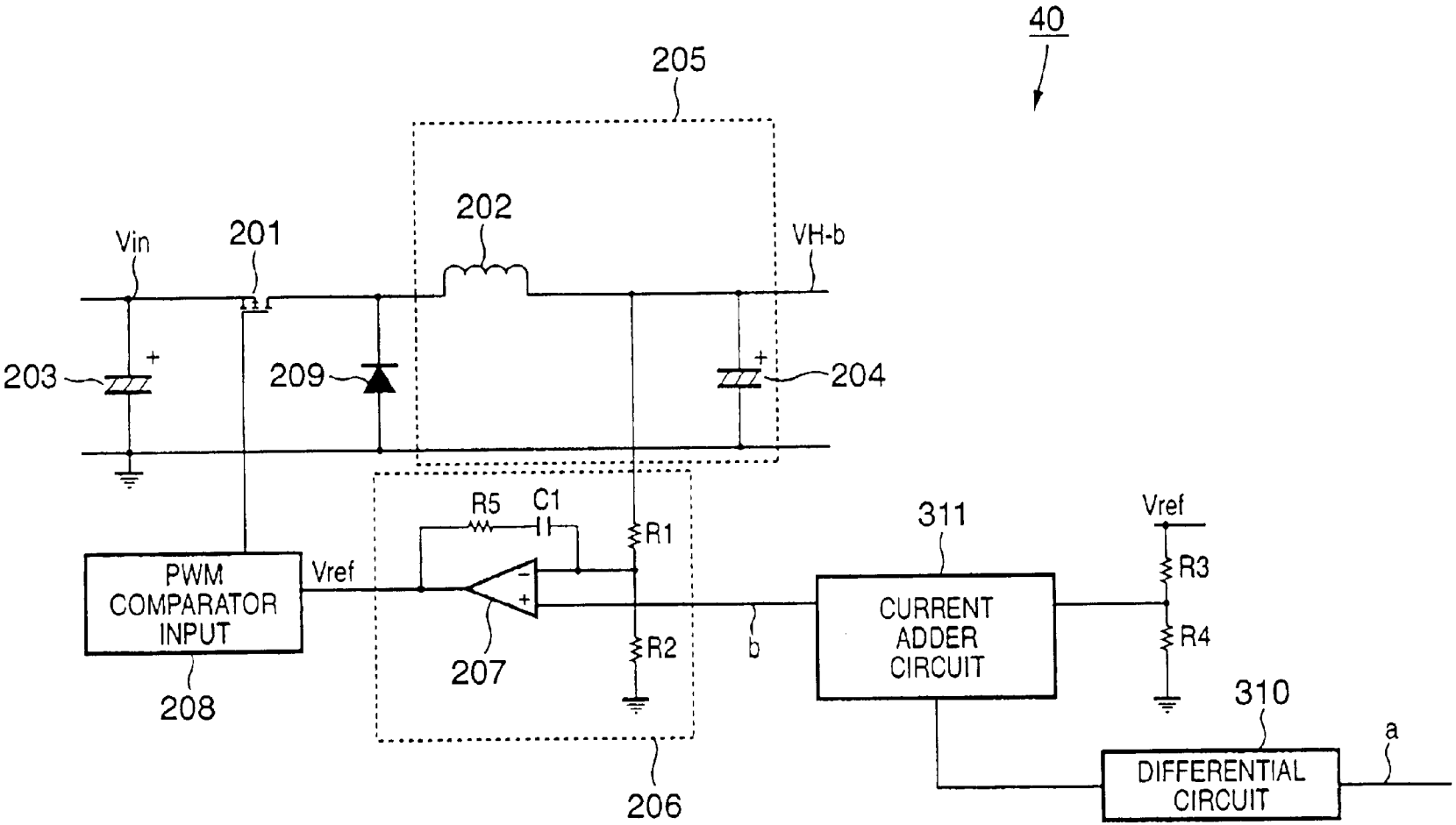
FIG. 4 is a block diagram of the DC/DC converter 40 of an inkjet printing apparatus according to the first embodiment of the present invention.
Figure 5A:
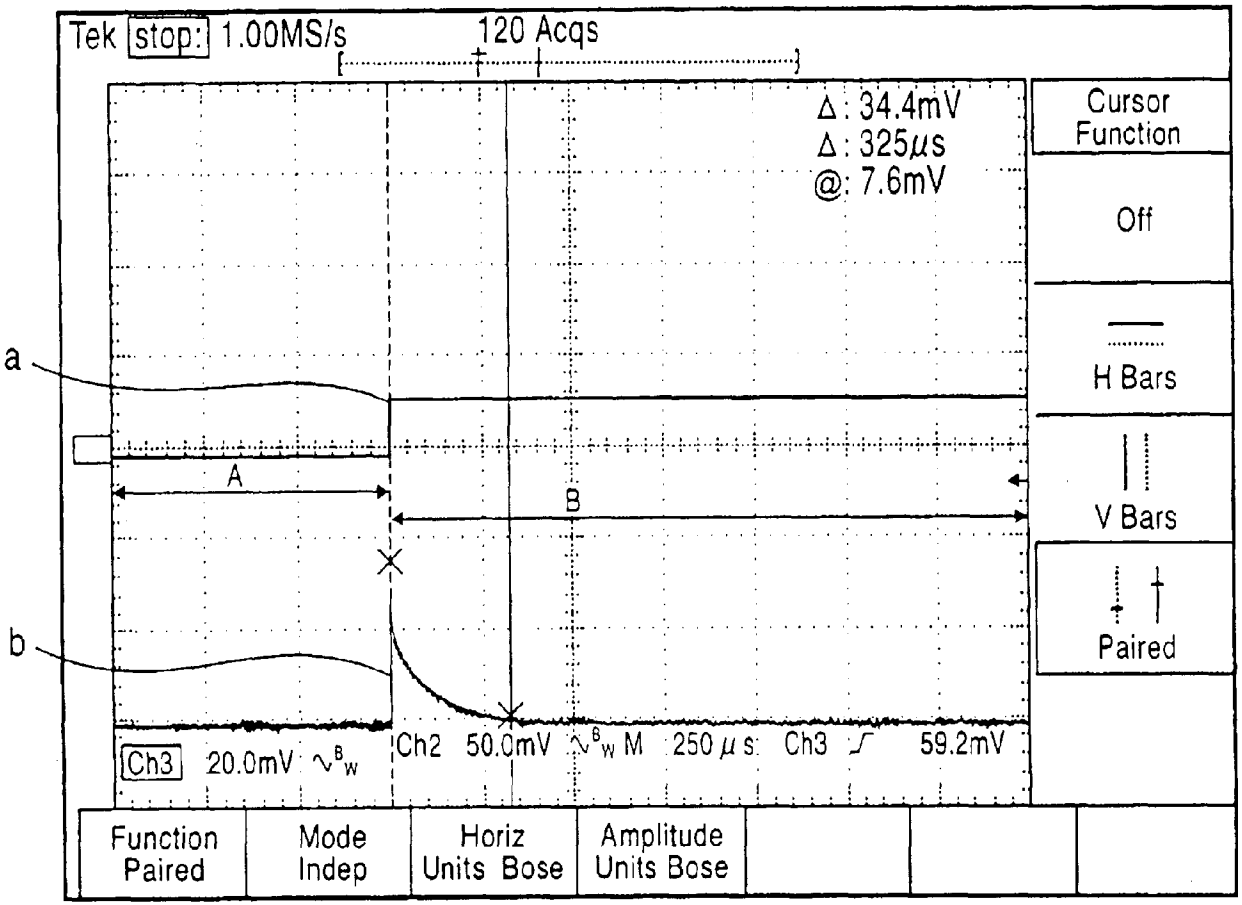
FIGS. 5A and 5B are diagrams showing waveforms of a variety of signals handled by the DC/DC converter 40 of an inkjet printing apparatus according to the first embodiment of the present invention.
Figure 5B:
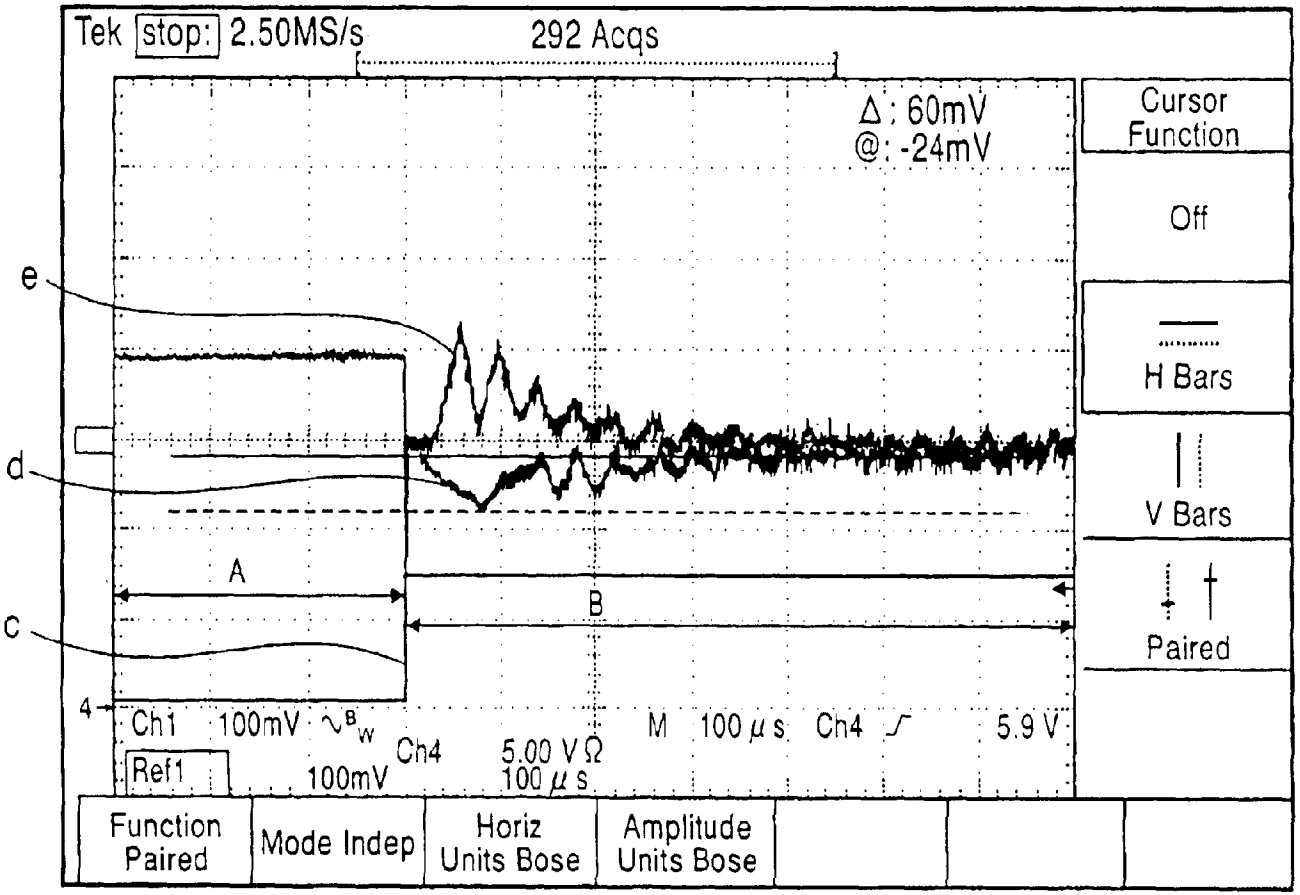

Next, a description is given of the actual composition and operation of the DC/DC converter 40, with reference to FIGS. 4, 5A and 5B.

FIG. 4 is a block diagram of the DC/DC converter 40 of an inkjet printing apparatus according to a first embodiment of the present invention.

The output of the differential circuit 310 of the control voltage correction circuit 39 in the DC/DC converter 40 is connected to the current adder circuit 311. A logic signal transmitted from the load transition detection circuit 38 is differentiated by the differential circuit 310, and the resulting differentiated waveform signal is added to the DC electric potential input to the non-inverted (+) terminal of the differential amplifier 207 after the reference electric potential ($V_{ref}$) is voltage-divided by the third resistance R3 and the fourth resistance R4.

FIGS. 5A and 5B are diagrams showing waveforms of a variety of signals handled by the DC/DC converter 40 of an inkjet printing apparatus according to a first embodiment of the present invention.

Waveform a of FIG. 5A is the logic signal when the load transition detection circuit 38 detects a transition from an actual continuous no-load state to a continuous all-nozzle discharge state (which is a state where all nozzles simultaneously discharge ink) as indicated by the serial data signal 37-13, and synchronizes with the heat signal 37-12 and outputs (a in FIG. 4). Waveform b of FIG. 5A shows a DC electric potential, input to the non-inverted (+) terminal of the differential amplifier 207, which is obtained from adding the differentiated waveform to the electric potential obtained by voltage-dividing the reference electric potential ($V_{ref}$) by the third resistance R3 and the fourth resistance R4 by the current adder circuit 311.

In addition, interval A of FIG. 5A denotes a continuous no-load interval in which no electric current flows to the printhead and interval B is an interval that denotes a state of continuous all-nozzle discharge.

To return to FIG. 4 and continue the description: The timing of the ON/OFF action of the switching element is adjusted so that the output voltage (VH-b) from the DC/DC converter 40 matches the voltage at the inverted (−) and non-inverted (+) terminals of the differential amplifier 207. As a result, the output voltage is controlled in such a way that the output voltage (VH-b) increases by the electric potential which is the amount indicated by the differentiated waveform which overlaps an electric potential obtained from voltage-dividing the reference electric potential ($V_{ref}$) by the third resistance R3 and the fourth resistance R4.

The increase of the output voltage (VH-b) is timed by the heat signals 37-12 to coincide with ink discharge from the nozzles caused by the serial signal transmitted by the register inside the printhead, so the electric charge released by the condenser inserted into the output terminal during the interval in which the feedback control circuit gain (K) is inadequate due to rapid load transitions works in a corrective direction, offsetting the drop in output voltage.

FIG. 5A depicts the waveform obtained when compensating for the drop in output voltage during actual transition from a continuous no-load state to a continuous all-nozzle discharge state in a case where the load transition detection circuit 38 and the control voltage correction circuit 39 are added.

In FIG. 5B, waveform c indicates the current that the DC/DC converter 40 supplies to the discharge nozzles of the printhead, waveform d is the output voltage waveform in a case where there is no load transition detection circuit 38 and no control voltage correction circuit 39, and waveform e is the output voltage waveform in a case where the load transition detection circuit 38 and the control voltage correction circuit 39 are added.

In addition, interval A in FIG. 5B denotes a continuous no-load interval in which no current flows to the printhead and interval B is an interval that denotes a state of continuous all-nozzle discharge.

It should be noted that the latch circuit 307 of FIG. 3 is reset by the inverted signal of the detection signal 302-1 from the heavy load detection circuit 302.

Figure 6:
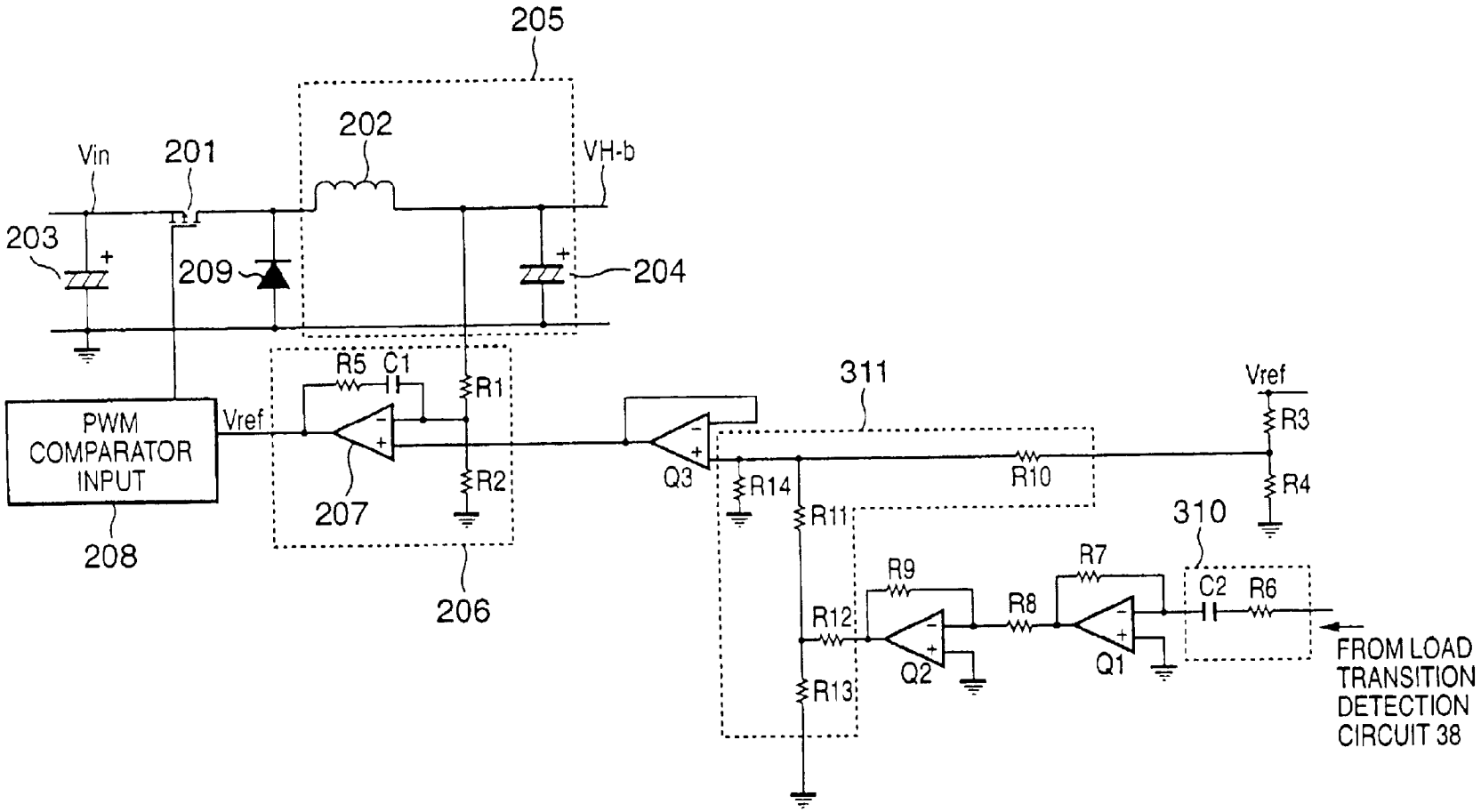
FIG. 6 is a block diagram of control voltage correction circuit 39 of an inkjet printhead according to a first embodiment of the present invention.

Next, a description is given of the composition and operation of the control voltage correction circuit 39, with reference to FIG. 6.

FIG. 6 is a block diagram of control voltage correction circuit 39 of an inkjet printhead according to a first embodiment of the present invention.

As shown in FIG. 6, the differential circuit 310 is composed of a resistance R6 and a condenser C2 provided at the input stage. In the present embodiment, by using a two-step construction consisting of inverse amplifiers Q1, Q2, the gains of the inverse amplifiers Q1, Q2 are adjusted according to the values of R6, R7, R8 and R9.

In addition, the current adder circuit 311 is composed of a ladder-type D/A converter structure created by using resistances R10, R11, R12, R13 and R14. When a control signal is input from the load transition detection circuit 38, through the differential circuit 310 and the current adder circuit 311 a differentiated waveform is added to the electric potential achieved by voltage-dividing the reference electric potential ($V_{ref}$) by the third resistance R3 and the fourth resistance R4, and input to the non-inverted (+) terminal of the differential amplifier 207.

Therefore, as shown in FIG. 5B, the voltage is controlled so as to raise the output voltage only in the interval in which the differentiated waveform is added as shown in FIG. 5B.

When there is no control signal input from the load transition detection circuit 38, the output voltage (VH-b) is controlled only by the DC electric potential achieved by voltage-dividing the reference electric potential ($V_{ref}$) by the third resistance R3 and the fourth resistance R4.

Follower circuit Q3 is inserted only because of signal attenuation considerations, and is not needed if the signal waveform and level do not change.

In addition, since the current adder circuit 311 has ladder-type D/A converter construction, it is also easy to employ multi-stage control in the form of even finer load detections depending on the number of nozzles discharging ink.

Therefore, in accordance with the above-described embodiment of the present invention, a no-load state or a state in which an extremely small number of nozzles discharge ink (that is, a light load state) that continues for a certain length of time which the light load detection circuit 301 detects according to the signals of the BK data counter 37-4 is held by the latch circuit, and an all-nozzle discharge state or a state in which ink is discharged from most of the nozzles (that is, a heavy load state) which the heavy load detection circuit 302 detects and an intermediate load which the medium load detection circuit 303 detects, are detected by the AND circuit 306, so the load transition detection circuit 38 can detect only a particular instantaneous transition, from a state in which no current is flowing or where there is a light load state to a state in which all the nozzles are discharging ink simultaneously or where there is a heavy load, of an electric current that the DC/DC converter 40 supplies.

It should be noted that, in the case of a transition in simultaneous nozzle discharge state that is not detected by the load transition detection circuit 38, there is no signal input to the input terminal of the differential circuit 310 of the control voltage correction circuit 39, so the signal level at that input terminal is the ground signal level. This indicates that the signal input to the plus (+) terminal of the differential amplifier of the DC/DC converter control circuit is only the DC electric potential achieved by voltage-dividing the reference voltage (V ref) generated inside the control IC unit inside the DC/DC converter by the third and fourth resistances R3 and R4, and normal constant voltage control is performed.

As described above, the light load detection circuit 301 and the heavy load detection circuit 302 detect, based on serial data signals input from an external device, a rapid load transition, that is, a switching timing from an interval in which the printhead is operating under no load or a light load interval in which ink discharge is not occurring or slight to a heavy load interval in which all or nearly all the nozzles of the printhead are discharging ink. And, by adding a differentiated waveform signal to the reference voltage within a feedback control loop provided within the DC/DC converter, it becomes possible to compensate for a voltage drop in the interval during which the constant voltage control circuit cannot track such a rapid load transition. Moreover, it is possible to supply a steady output voltage from the DC/DC converter even when driving the printhead under conditions in which the load changes in discrete steps. By so doing, an adequate voltage is applied to the nozzles of the printhead under all conditions, and as a result, high-quality printing can be performed and high picture quality can be maintained.

Moreover, since it is possible to predict rapid load transitions prior to actual printing and to compensate for the attendant voltage drops, the capacity of the condenser conventionally provided and connected to the DC/DC converter output terminal can be reduced, thus providing the advantage of contributing to reductions in size and thickness of the DC/DC converter.

<Second Embodiment>

A description is now given of a printing apparatus and voltage control method according to a second embodiment of the present invention, with reference to FIGS. 7, 8, 9A, 9B and 10. In this second embodiment, a time constant circuit 312 is introduced between the current adder circuit 311 and the differential circuit 310 inside the control voltage correction circuit 39 of the first embodiment of the present invention described above. For the sake of brevity, components appearing in FIGS. 7–10 that are the same as those already described with reference to the first embodiment are given the same reference numerals and a description thereof is herein omitted.

The time constant circuit 312 of the second embodiment functions to dampen the differentiated waveform signal obtained by differentiating the signal that the load transition detection circuit 38 inputs to the differential circuit 310.

FIG. 7 is a block diagram of the internal construction of the head control block 37, the load transition detection circuit 38, the control voltage correction circuit 39 and the printhead of an inkjet printing apparatus according to a second embodiment of the present invention. As can be appreciated by a comparison with FIG. 3, the time constant circuit 312 is provided between the differential circuit 310 and the current adder circuit 311.

Figure 8:
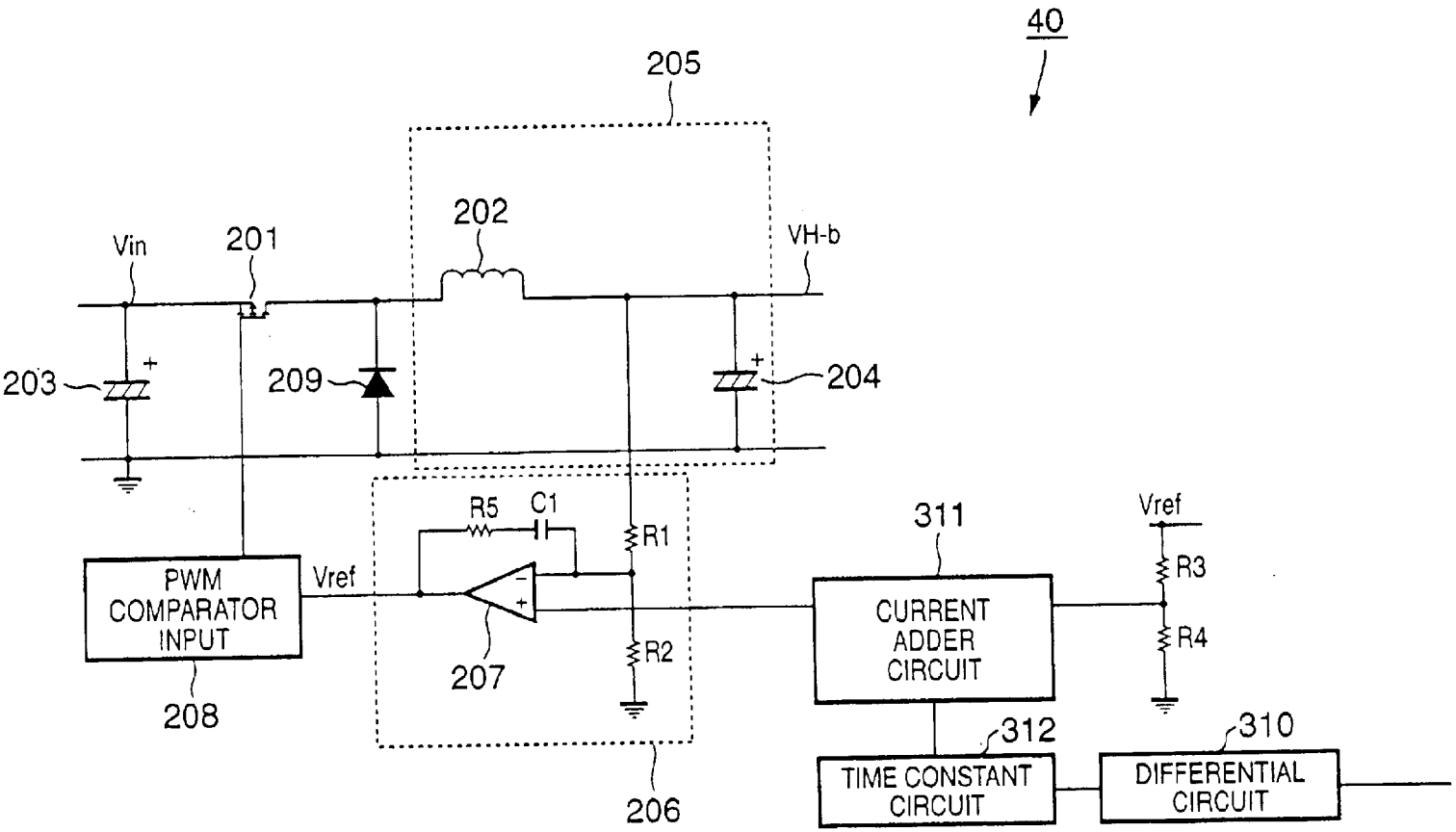
FIG. 8 is a block diagram of the DC/DC converter 40 of an inkjet printing apparatus according to the second embodiment of the present invention.

FIG. 8 is a block diagram of the DC/DC converter 40 of an inkjet printing apparatus according to the second embodiment of the present invention. As can be appreciated by a comparison with FIG. 4, the time constant circuit 312 is provided between the differential circuit 310 and the current adder circuit 311.

Figure 9A:
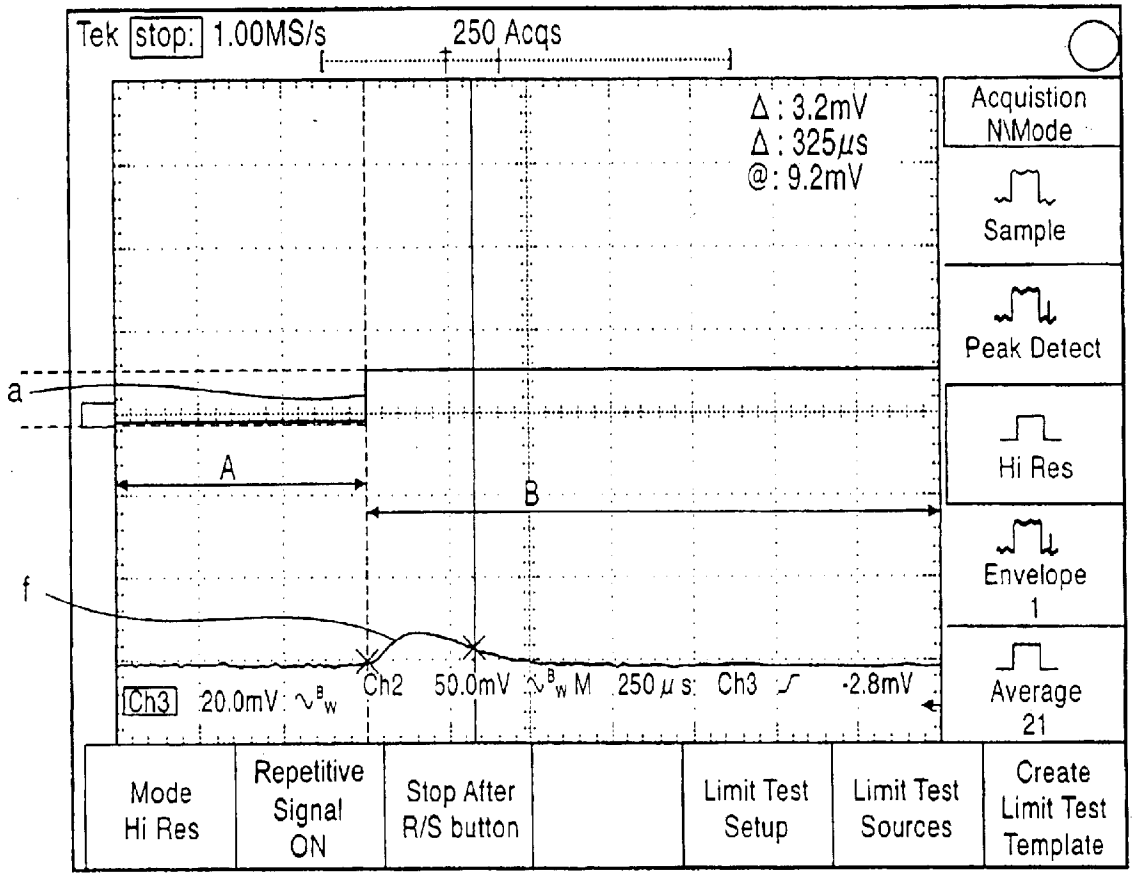
FIGS. 9A and 9B are diagrams showing waveforms of a variety of signals handled by the DC/DC converter 40 of an inkjet printing apparatus according to the second embodiment of the present invention.
Figure 9B:
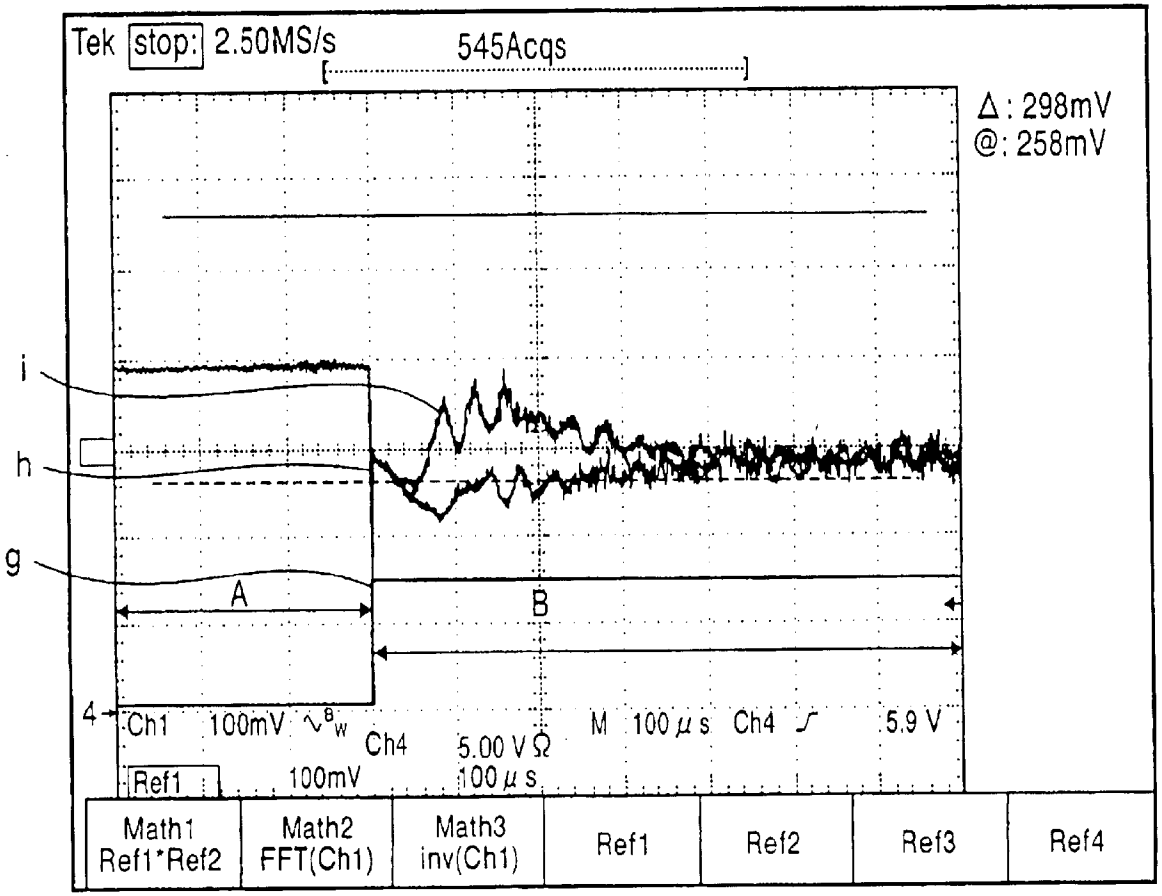

FIGS. 9A and 9B are diagrams showing waveforms of a variety of signals handled by the DC/DC converter 40 of an inkjet printing apparatus according to the second embodiment of the present invention.

By providing the time constant circuit 312, the differentiated waveform is dampened and waveform b shown in FIG. 5A becomes waveform f shown in FIG. 9A. The DC/DC converter 40 is configured so as to compensate for the voltage drop when the voltage drop caused by the delay of the constant voltage feedback control circuit is at its maximum by using the current adder circuit 311 to add the differentiated waveform dampened by the time constant circuit 312 to the DC electric potential achieved by voltage-dividing the reference voltage (V ref) by the third and fourth resistances R3 and R4.

FIG. 9B is a diagram showing the waveform obtained by interposing the time constant circuit 312 between the differential circuit 310 and the current adder circuit 311 and compensating for the output voltage drop during transition from a continuous no-load state to a continuous all-nozzle discharge state. In FIG. 9B, waveform g denotes the current waveform that the DC/DC converter 40 supplies to the printhead, waveform h denotes the output voltage waveform in a case where neither the load transition detection circuit 38 nor the control voltage correction circuit 39 is provided, and waveform i denotes the waveform obtained in a case where the control voltage correction circuit 39 including the time constant circuit 312 and the load transition detection circuit 38 are added in accordance with the present embodiment.

In addition, in FIGS. 9A and 9B, interval A denotes a continuous no-load interval in which no current flows to the printhead and interval B is an interval that denotes a state of continuous all-nozzle discharge.

Figure 10:
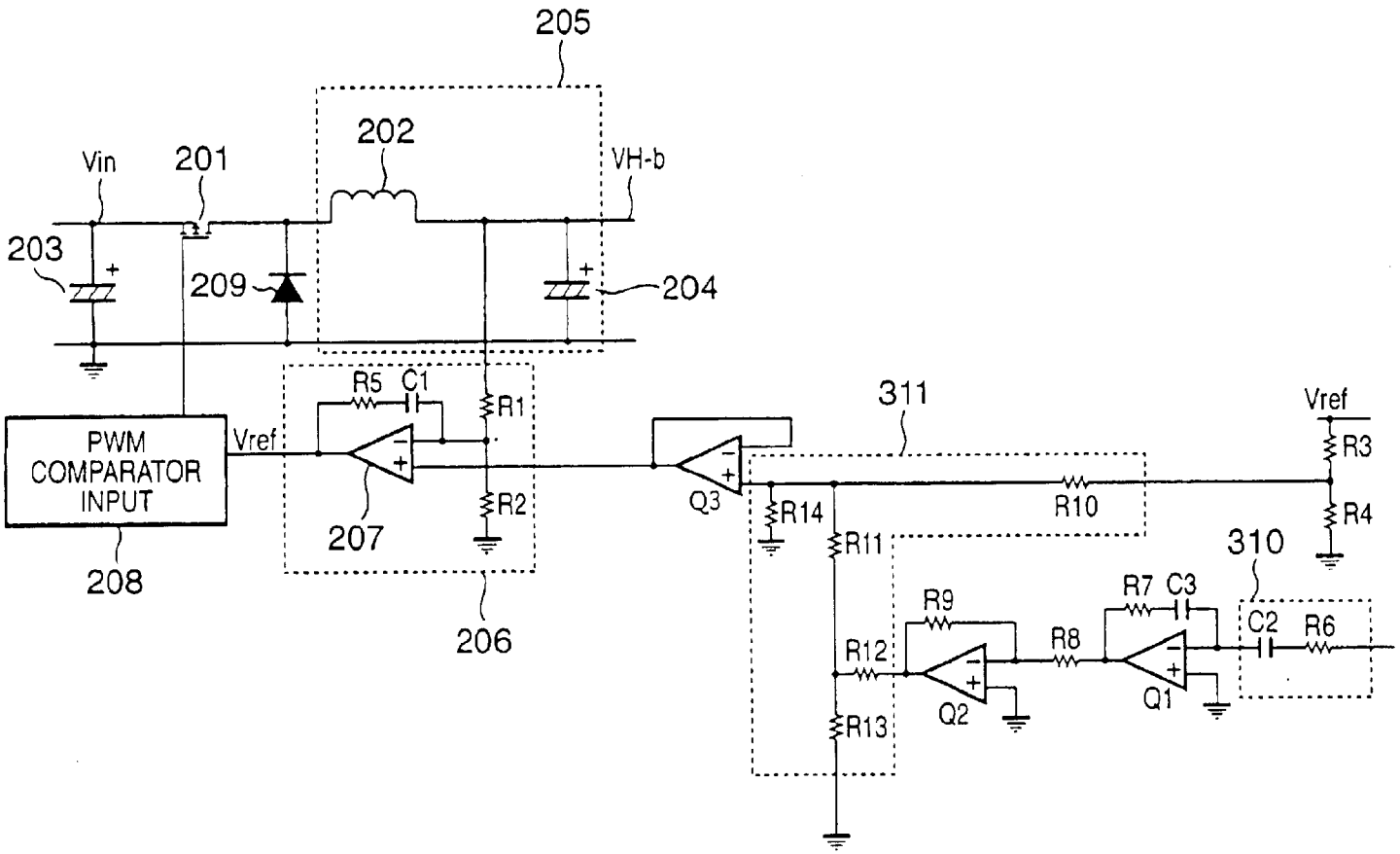
FIG. 10 is a block diagram of control voltage correction circuit 39 of an inkjet printhead according to the second embodiment of the present invention.
Figure 11:
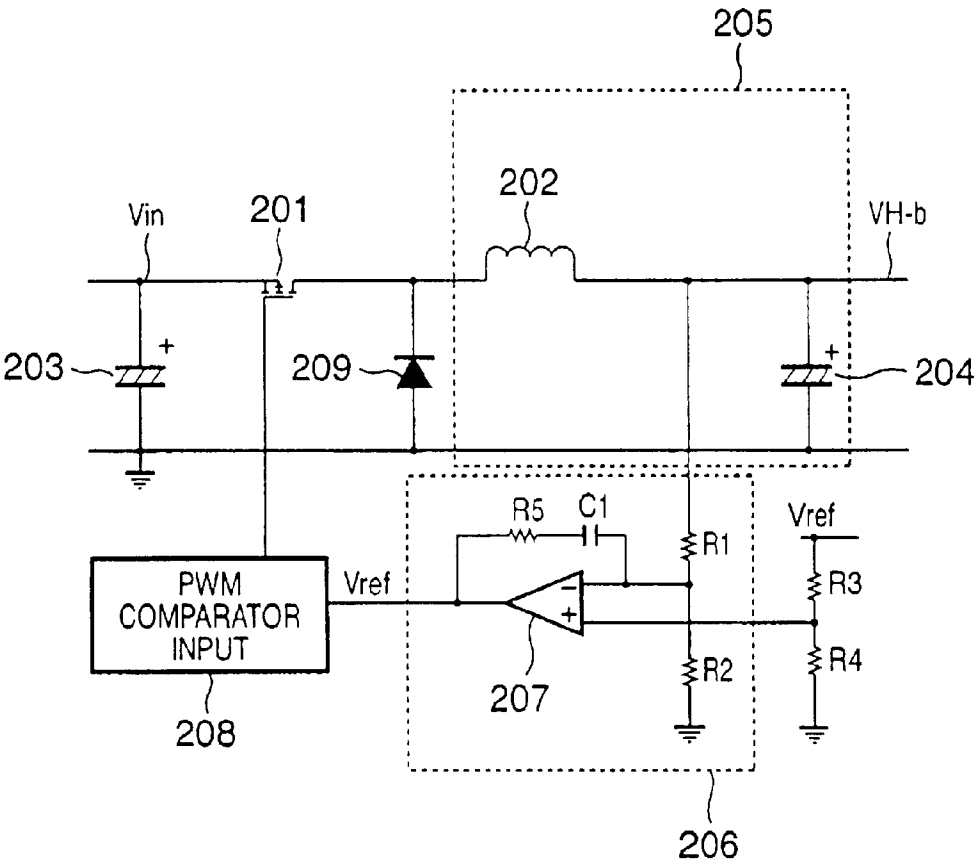
FIG. 11 is a block diagram of a voltage control circuit that forms a part of a DC/DC converter.

Next, a description is given of the operation of a control voltage correction circuit according to the present embodiment, with reference to FIG. 10.

FIG. 10 is a block diagram of a control voltage correction circuit 39 of an inkjet printhead according to the second embodiment of the present invention.

As can be appreciated by comparing FIG. 6 and FIG. 10, the major difference between the first embodiment and the second embodiment is that the latter serially inserts a condenser C3 behind a resistance R7 which is inserted between the inverted terminal of the amplifier Q1 and the output terminal of the amplifier Q1 so as to form the time constant circuit 312 which dampens the differentiated waveform differentiated from the logic signal by resistance R6 and condenser C2.

Therefore, a differentiated waveform dampened by the resistance R7 and the condenser C3 is added to the electric potential achieved by voltage-dividing the reference electric potential ($V_{ref}$) by the third and fourth resistances R3 and R4 by the current adder circuit 311 which is a ladder-type D/A converter consisting of resistances R10, R11, R12, R13 and R14 and input to the non-inverted (+) terminal of the differential amplifier 207.

Therefore, according to the above-described embodiment, since the differential circuit 310 forms a waveform in which the edge portion of the logic signal is at its greatest, the incidence of the maximum voltage drop caused by the delay in control exerted by the constant voltage control circuit during actual rapid load transitions is offset, so by adding the time constant circuit 312 and dampening the differentiated waveform, the maximum value of the signal waveform input to the current adder circuit is matched to the point of maximum voltage drop due to such a rapid load transition, enabling more precise and accurate voltage control.

In addition, although not specifically described in the foregoing explanation of the embodiments, as can be appreciated by those of ordinary skill in the art, a conveyance motor control signal or motor drive signal may be incorporated as a signal capable of detecting a mode where the printhead is not driven in the light load detection circuit in consideration of conveyance of the print medium or initialization operation and the like.

Moreover, as can be appreciated by those of ordinary skill in the art, although in the above-described embodiments the same output voltage from the DC/DC converter is supplied to each of the four printheads, in actuality the present invention is not limited to such a configuration but contemplates, for example, configurations in which two different voltages are applied (one for black-and-white printing and the other for color printing), or a multi-output configuration in which different voltages are output to each of the four printheads. In such cases, the load transition detection circuit 38 and the control voltage correction circuit 39 may be provided for each voltage or on each output voltage control circuit.

Moreover, in the above-described embodiments, as shown for example in FIG. 3 and FIG. 7, the printhead 2-1 and the color printheads 2-2 through 2-4 use two separate power sources in the form of output DC/DC converters. However, the DC/DC converter may be configured so as to calculate the counts of the serial data signals of print data of each color and provide a uniform output voltage, or, alternatively, to count the serial data for each of the printheads separately and provide different output voltages for each printhead.

Note that, in the description of the above embodiment, a liquid droplet discharged from the printhead is ink, and the liquid stored in the ink tank is also ink. However, the liquid stored in the ink tank is not limited to ink. For example, the ink tank may store a processing liquid to be discharged onto a print medium so as to improve fixability and water repellency of a printed image or to improve its image quality.

Each of the embodiments described above comprises means (e.g., an electrothermal transducer) for generating heat energy as energy utilized upon execution of ink discharge, and adopts the method which causes a change in the state of ink by the heat energy, among the ink-jet printing method. According to this printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of a so-called on-demand type or continuous type system. Particularly, in the case of the on-demand type, the system is effective because, by applying at least one driving signal, which corresponds to printing information and causes a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Publication Laid-Open No. 59-123670 which discloses the arrangement using a slot common to a plurality of electrothermal transducers as a discharge portion of the electrothermal transducers, or Japanese Patent Publication Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, the present invention may employ not only a cartridge type printhead, in which an ink tank is integrally arranged on the printhead itself, but also an exchangeable chip type printhead which can be electrically connected to the apparatus main unit and can receive ink from the apparatus main unit upon being mounted on the apparatus main unit.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independent of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

In addition, the ink-jet printer of the present invention may be used in the form of a copying machine combined with a reader, and the like, or a facsimile apparatus having a transmission/reception function, in addition to an integrally-provided or stand-alone image output terminal of an information processing equipment such as a computer.

As many apparently widely different embodiments of the present invention can be made without departing from the spirit and scope thereof, it is to be understood that the invention is not limited to the specific embodiments thereof except as defined in the claims.

What is claimed is:

1. A printing apparatus for printing on a printing medium by moving a printhead including a plurality of printing elements, comprising:

input means for inputting print data transmitted from an external device;

a carriage, in which the printhead is mounted and a voltage control unit that supplies a controlled voltage for driving the plurality of printing elements of the printhead is provided, for moving the printhead;

counting means for counting a number of printing elements of the printhead to be driven based on the print data input by said input means;

evaluation means for evaluating an extent of a load of a succeeding print cycle to be applied to the printhead based on a count result by said counting means; and control means for inputting an evaluation signal indicating an evaluation result by said evaluation means to the voltage control unit, and controlling the voltage based on the evaluation signals, wherein the voltage control unit is a DC/DC converter, and wherein the DC/DC converter includes:

a differential circuit that detects a signal change in the evaluation signal; and an adder circuit that adds an output from the differential circuit to a reference voltage of the DC/DC converter.

2. The apparatus according to claim 1, wherein said evaluation means evaluates the extent of the load in multiple stages.

3. The apparatus according to claim 2, wherein said evaluation means includes at least a light load detection circuit, a heavy load detection circuit and a medium load detection circuit.

4. The apparatus according to claim 1, wherein the DC/DC converter further comprises a time constant circuit for dampening detection of a signal change by the differential circuit.

5. The apparatus according to claim 1, wherein the printhead is an inkjet printhead for printing by discharging ink.

6. The apparatus according to claim 5, wherein the inkjet printhead comprises:

a first inkjet printhead that discharges black ink;

a second inkjet printhead that discharges cyan ink;

a third inkjet printhead that discharges magenta ink; and a fourth inkjet printhead that discharges yellow ink.

7. The apparatus according to claim 5, wherein the inkjet printhead comprises an electrothermal transducer that generates thermal energy to be applied to the ink in order to discharge the ink.

8. The apparatus according to claim 1, wherein said counting means counts each black data, cyan data, magenta data and yellow data color component.

9. The apparatus according to claim 8, wherein said evaluation means outputs a black-and-white evaluation signal based on the black data and a color evaluation signal based on the cyan data, the magenta data and the yellow data; and the voltage control unit supplies both a drive voltage for black-and-white printing and a drive voltage for color printing.

10. A voltage control method for controlling a drive voltage for driving a printhead having a plurality of printing elements mounted on a printing apparatus for printing on a printing medium, comprising the steps of:

inputting print data transmitted from an external device;

counting a number of printing elements of the printhead to be driven based on the input print data;

evaluating an extent of a load of a succeeding print cycle to be applied to the printhead based on the count result; and inputting an evaluation signal indicating the evaluation result to a DC/DC converter for supplying a controlled voltage so as to drive the plurality of printing elements, and controlling the voltage based on the evaluation signal, wherein a signal change in the evaluation signal is detected by a differential circuit, and an output from the differential circuit is added to a reference voltage of the DC/DC converter by an adder circuit.

* * * * *